United States Patent [19]

Akagi

[11] Patent Number: 4,777,740

[45] Date of Patent: Oct. 18, 1988

[54] TEMPERATURE-PROOF SHOES

[76] Inventor: Katsuji Akagi, 1565 Onoue, Okayama-city, Japan

[21] Appl. No.: 22,429

[22] Filed: Mar. 6, 1987

[51] Int. Cl.[4] ..... A43B 13/04; A43B 13/18; A43B 15/00; A43B 23/07

[52] U.S. Cl. ..... 36/55; 36/14; 36/17 R; 36/78

[58] Field of Search ..... 36/4, 14, 16, 17 R, 36/17 PW, 55, 78

[56] References Cited

U.S. PATENT DOCUMENTS

| | | | |
|---|---|---|---|
| 5,362,292 | 3/1895 | Pickering | 36/14 |
| 2,273,977 | 2/1942 | Mitchell | 36/14 |
| 3,350,795 | 11/1967 | Schlecht | 36/55 X |
| 4,170,802 | 10/1979 | Roy | 36/14 X |

*Primary Examiner*—Stuart S. Levy
*Assistant Examiner*—Thomas R. Hannon
*Attorney, Agent, or Firm*—Koda and Androlia

[57] ABSTRACT

A temperature-proof shoe formed by adhering a hollowed shape forming guide plate, which is circumferentially larger than an insole board that is the same size as the bottom surface of a form block, to the underside of a closed cell polyurethane foam layer at the sole portion of a shoe, and tucking in a leather facing in a manner to wrap up the forming guide plate with it. Also, by a roll-in outstitching applied to the leather facing and the outer circumference of the forming guide plate protruding to the outside from the leather facing of the instep portion, the temperature-proof shoes are free from the intrusion of water, satisfactory in heat-retaining property and excellent in design.

3 Claims, 2 Drawing Sheets

TEMPERATURE-PROOF SHOES

BACKGROUND OF THE INVENTION

1. Field of the Invention

This invention relates to temperature-proof shoes and a method of making same, and particularly to temperature-proof shoes having an excellent heat retaining property by the use of composite sheets of thick leather and heat insulating material and also having an elegant finished form like ordinary men's shoes.

2. Description of the Prior Art

Temperature-proof shoes known conventionally to have an outstanding heat retaining effect are those using a three layer structure of leather with closed cell polyurethane foam provided as an intermediate layer. These temperature-proof shoes are provided with the temperature-proofing property by heat insulating effect shown by the closed cell polyurethane foam.

However, as shown in a partial longitudinal section in FIG. 4, the shoes using the three layer structure composed of a leather facing 11, a leather lining 12 and an intermediate layer made of closed cell polyurethane foam 13 had certain problems including that, during the tuck-in forming in the process prior to the fastening of main sole, the soft and weak polyurethane foam layer 13 loses its resiliency or its foam is crushed by getting excessively pressed by the peripheral edge of the bottom of a form block A or by the peripheral edge of an insole 14, thereby spoiling the wearing comfort, and that an aesthetically satisfactory contour line cannot be obtained for the portion where the leather is folded along the bottom peripheral edge of the form block A and the peripheral edge of the insole board 14 (hereafter, this portion will be called the tucked-in bent portion). Consequently, tuck-in forming has required skilled techniques which depend on many years of experience and a delicate sense of a seasoned craftsman. Thus, it has been very difficult to obtain well-finished and high quality products.

Also, as shown in a partial longitudinal section in FIG. 6, when the conventional method of sewing the insole board 14 to the main sole 17 by the roll-in type topstitching, because the polyurethane foam layer 13 is thick, a proper form could not be obtained, and also, the intrusion of water from outside through the seam can not be prevented.

SUMMARY OF THE INVENTION

Temperature-proof shoes and a method of making the same are provided by this invention which are completed as the result of various studies conducted in order to solve the above mentioned problems accompanying the prior art. The temperature-proof shoes thus obtained are those which are made by tuck-in forming of the three layer leather structure composed of an upper leather facing, a leather lining and a closed cell polyurethane foam layer as an intermediate layer provided between the foregoing two leather layers, by using a form block. Along the peripheral edge at the sole portion of the foregoing closed cell polyurethane foam layer, between the closed cell polyurethane foam layer and the leather facing, a forming guide plate that is made into a hollowed form and that is larger than an insole board having a size similar to that of the bottom surface of the form block, for the entire periphery, is provided. As the forming guide plate, one should be provided that is nearly matching in shape and size to the outer circumferential edge of the closed cell polyurethane foam layer at the sole portion, or, in an outstitching method, that has a shape and size which sticks out from the insole board at its outer circumferential edge by a portion equivalent to the total thickness of the closed cell polyurethane foam layer and the leather facing plus the sewing margin, along the whole circumference.

The method for manufacturing the above mentioned temperature-proof shoes is as described below. That is, the process of tuck-in forming of the three layer leather structure composed of a leather facing, a leather lining and a closed cell polyurethane foam layer as the intermediate layer by using the form block, the leather lining and the insole leather, as an extension of the leather lining, are shaped by fitting them tightly to the foregoing form block. At the same time, the insole board with the same size as that of the insole leather is joined with the insole leather. Then, the closed cell polyurethane foam layer is adhered to the leather lining and the insole board, and along the outer circumferential edge of the closed cell polyurethane foam layer at the sole portion, the hollow forming guide plate having a shape and size nearly matching to the above mentioned outer circumferential edge is provided between the closed cell polyurethane foam layer and the leather facing, in a form to be adhered to the polyurethane foam layer and the leather facing. Then, the leather facing is tucked in a manner to wrap up the forming guide plate. When applying outstitching, a forming guide plate having a shape and size which allows the outer circumference of the forming guide plate to stick out from the insole board, for the whole circumference, by a portion equivalent to the total thickness of the closed cell polyurethane foam layer and the leather facing plus the sewing margin, is used. Then, by tucking in the leather facing in a form of wrapping up the forming guide plate with the leather facing, outstitching is provided to the protruded portion formed by the forming guide plate.

For the forming guide plate, it is preferable to use a relatively hard and resilient material. When such a forming guide plate is adhered as described above, along the circumferential edge of the closed cell polyurethane foam layer at the sole portion, the forming guide plate functions to protect the tuck-in bent portion of the closed cell polyurethane foam layer that is soft and weak thereby tending to get out of shape, and to prevent the loss of resiliency as well as the crushing of independent foam due to the pressure applied to the tuck-in bent portion of the polyurethane foam layer. Also, a neat contour line of the tuck-in bent portion can be obtained. As a result, the shoes are finished into an elegant shape. Furthermore, in the case of providing the outstitches, the intrusion of water from the seams is prevented completely by being blocked by the closed cell polyurethane foam layer that is provided in a continuous form.

DETAILED DESCRIPTION OF THE INVENTION

A detailed description of the embodiments of the present invention will hereunder be provided with reference to the drawings.

Figure 2:
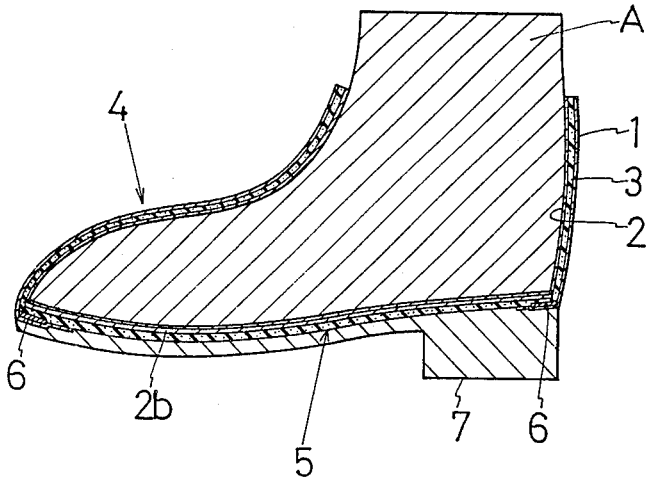
FIG. 2 is an overall central longitudinal section of the temperature-proof shoes provided by the present invention.
Figure 3:
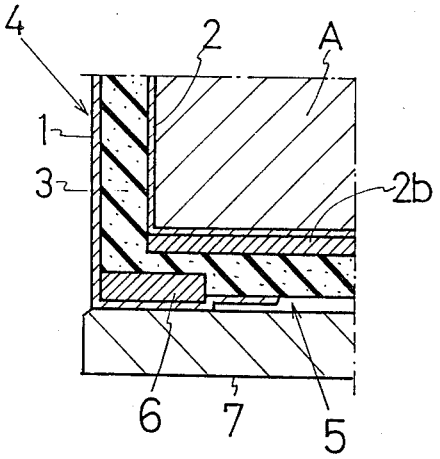
FIG. 3 is a longitudinal section showing the state of the tuck-in bent portion of the temperature-proof shoes according to this invention.
Figure 4:
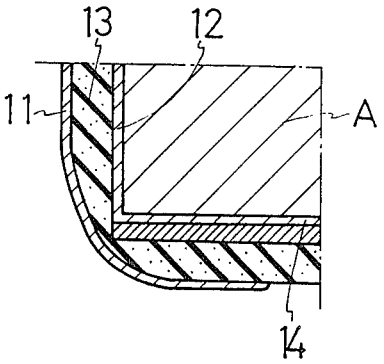
FIG. 4 is a longitudinal section of the essential portion showing the tuck-in bent portion of the conventional product.
Figure 5:
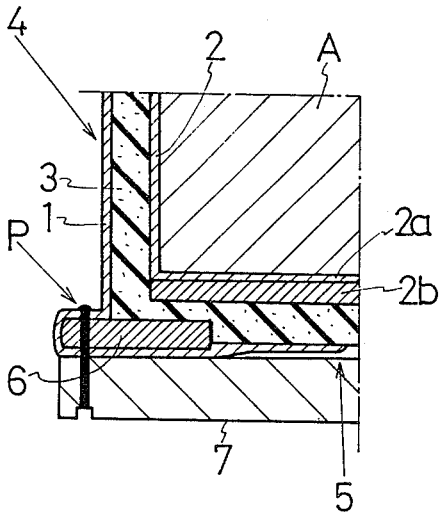
FIG. 5 is a longitudinal section showing the tuck-in bent portion with outstitching applied to it in the temperature-proof shoes provided by the present invention.
Figure 6:
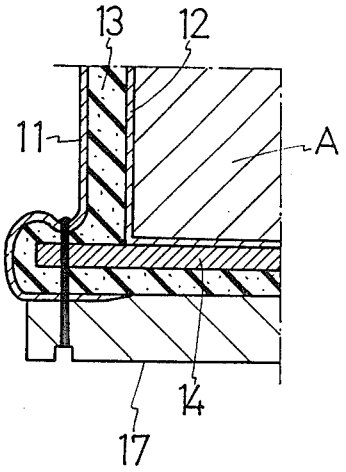
FIG. 6 is a longitudinal section showing the tuck-in bent portion by use of outstitching in the conventional temperature-proof shoes.

The temperature-proof shoes according to the present invention, which are shown in FIG. 2, FIG. 3 and FIG. 5 use a three layer leather structure composed of a leather facing 1, a leather lining 2 and a closed cell polyurethane foam layer 3 as the intermediate layer disposed between the former two leather layers, for the instep portion 4. The sole portion 5 of these shoes has a three layer structure composed of an insole leather 2*a* (for example, an extension of the leather lining), an insole board 2*b* provided under the insole leather 2*a*, and the above mentioned closed cell polyurethane foam layer 3, with a main sole 7 fitted to the underside of the foregoing sole portion 5. The entire area of the above mentioned three-layered instep portion 4 is shaped by tuck-in forming through the use of a form block A. To the sole portion 5, a forming guide plate 6 having a shape and size nearly fitting to the whole circumferential edge of the closed cell polyurethane foam layer 3 is adhered, and this forming guide plate 6 is tucked in a form to wrap it up with the leather facing 1 that is adhered to the closed cell polyurethane foam layer 3 of the instep portion 4. Then, the end portion of the foregoing leather facing 1 is adhered to the polyurethane foam layer 3 and the forming guide plate 6 in the sole portion 5. Thereafter, a main sole 7 is fitted by buffing adhesion to the closed cell polyurethane foam layer 3, with the foregoing forming guide plate 6 interposed in between.

Figure 1:
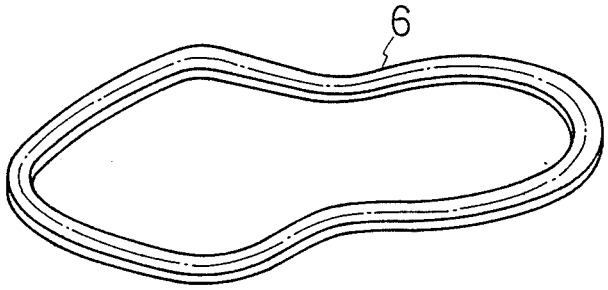
FIG. 1 is a perspective view of the forming guide plate used in the present invention.

The forming guide plate 6 is made of paper, synthetic resin, rubber, etc. which is relatively hard and has resiliency, so that the proper shape retaining function is obtained and also the wearing comfort is not spoiled. Its size is set to be such that it sticks out from the bottom surface circumferential edge of the form block A, along the entire circumference, by a portion equivalent to a thickness a little thinner (about 70%) than the polyurethane layer 3 (the alternate long and short dashed line in FIG. 1 shows the size of the bottom surface of the form block A). In other words, the forming guide plate 6 has a shape that nearly fits to the circumferential edge of the underside that is the sole portion 5 of the polyurethane foam layer 3 adhered to the leather lining 2 that is fitted to the form block A, and it is formed by punching or cutting out the inside portion of it in a manner to leave the zonal circumference edge portion having a width equivalent to more than twice of the thickness of the polyurethane foam layer 3.

The description of the steps to be taken for manufacturing the above mentioned shoes according to this invention will be given below.

First, to the instep portion 4 and the sole portion 5 of the form block A, the leather lining 2 and that obtained by adhering the insole leather 2*a* and the insole board 2*b* are applied. Then, onto the foregoing leather lining 2 and the insole board 2*b*, closed cell polyurethane foam with a specified thickness is adhered by using an adhesive. Along the circumferential edge of the underside of the closed cell polyurethane foam layer 3 thus formed, the previously mentioned forming guide plate 6 is adhered. Then the leather facing 1 is tucked in a form to wrap up the forming guide plate 6, and it is adhered to the forming guide plate 6 and the polyurethane foam layer 3 in the sole portion 5.

In the temperature-proof shoes according to this invention, which are manufactured as described above, as shown in FIG. 3, the forming guide plate 6 keeps the proper form and protects the tuck-in bent portion of the closed cell polyurethane foam layer 3, and also prevents the resiliency from being lost as well as the foam from being crushed due to deformation caused by localized pressure. Accordingly, products with outstanding wearing comfort and excellent temperature-proofing effect are obtained. In addition, unlike the conventional practice, without depending on the skilled techniques which rely on many years of experience and a sense of seasoned craftsmanship, the shoes can be finished, by the proper shape retaining function of the forming guide plate, to have a neat contour line in the tuck-in bent portion uniformly for the entire length, with simple work. Consequently, the production efficiency is improved, and while the cost is lower than that of the conventional products, products which are high in value and which are superior also in design are provided.

Also, for shoes employing outstitching, as shown in FIG. 5, the forming guide plate 6 is made to have a size to allow it to stick out from the insole board 2*b*, by a portion equivalent to the total thickness of the closed cell polyurethane foam layer 3 and the leather facing 1 plus the sewing margin, along the whole circumference, then, the outstitching is provided to the protruded portion P formed by forming guide plate 6, and furthermore, the leather facing 1 is rolled into the underside of the forming guide plate 6 and sewn to the main sole 7. As a result, a neat contour line can be obtained easily for the tuck-in bent portion, by the proper shape retaining function of the forming guide plate 6 in the same manner as the embodiment described previously. As a result, satisfactory appearance of the shoes can be obtained. At the same time, while conventional shoes of this type have not been free of water seeping through the seams of the outstitching, it has become possible to prevent such in this invention by forming the guide plate.

I claim:

1. Temperature-proof shoes of a three layer leather structure composed of a leather facing, a leather lining and a closed cell polyurethane foam layer provided as an intermediary layer between said two leather layers, said shoes being made by tuck-in forming with the use of a form block, characterized in that:

a hollow forming guide plate is provided along a circumferential edge of said closed cell polyurethane foam layer and between said closed cell polyurethane foam layer and said leather facing, and said guide plate being larger in circumference than an insole board which is similar in size to the bottom surface of the form block.

2. A temperature-proof shoes as set forth in claim 1, wherein the outer circumference of said forming guide plate has a shape and size which nearly fits the outer circumferential edge of said closed cell polyurethane foam layer at a sole portion.

3. A temperature-proof shoes as set forth in claim 1, wherein said forming guide plate has a size to allow an outer circumference of it to stick out from said insole board by a portion equivalent to the total thickness of said closed cell polyurethane foam layer and said leather facing plus a sewing margin, and outstitching is provided to the protruded portion formed by said forming guide plate.

* * * * *